United States Patent [19]

Riedl et al.

[11] Patent Number: 4,765,594

[45] Date of Patent: Aug. 23, 1988

[54] LIFTING AND DEPOSITING DEVICE FOR TRANSPORTABLE LARGER CONTAINERS, E.G. COMPARTMENTS OR THE LIKE

[75] Inventors: Reinhold Riedl, Miltenberg; Conrad Lazarus, Freudenberg, both of Fed. Rep. of Germany

[73] Assignee: haacon hebetechnik GmbH, Freudenberg, Fed. Rep. of Germany

[21] Appl. No.: 798,618

[22] Filed: Nov. 15, 1985

[30] Foreign Application Priority Data

Nov. 20, 1984 [DE] Fed. Rep. of Germany ..... 3442307

[51] Int. Cl.[4] ..... B66F 7/26

[52] U.S. Cl. ..... 254/45

[58] Field of Search ..... 254/45, 95; 280/47.13, 280/2, 79.1 A

[56] References Cited

U.S. PATENT DOCUMENTS

| | | | |
|---|---|---|---|
| 176,732 | 5/1876 | Altick | 280/47.13 R |
| 3,360,141 | 12/1967 | Martin | 254/45 |
| 4,169,581 | 10/1979 | Thurmond, Jr. | 254/45 |
| 4,537,416 | 8/1985 | Linaberg | 254/94 |
| 4,611,816 | 9/1986 | Traister et al. | 280/47.13 R |

*Primary Examiner*—Frederick R. Schmidt
*Assistant Examiner*—Judy J. Hartman
*Attorney, Agent, or Firm*—Frank P. Presta

[57] ABSTRACT

The lifting and depositing device for a large container has four rack and pinion jacks attached to its corners at a low point by overhang beams. The racks are fastened to uprights, along which the rack and pinion jacks can be raised and lowered by suitable operation. In order to move the large containers with the lifting and depositing device, the bottom ends of the uprights are connected by wheel supports with wheels. The wheels are mounted on a wheel swiveling mechanism which has a support surface for the bottom end of the uprights. The wheel swiveling mechanism is rotatable relative to the uprights for controllability of the device. Each support surface for an upright is provided on a rocker mounted on the wheel swiveling mechanism for rotation about a substantially horizontal axis. The support surface is arranged lower in relation to the axis of the wheels so that the wheel swiveling mechanism can be moved when a large container is placed on the ground to the side beneath the rack and pinion jack to position the bottom end of the adjacent upright on the support surface to support and couple them.

8 Claims, 8 Drawing Sheets

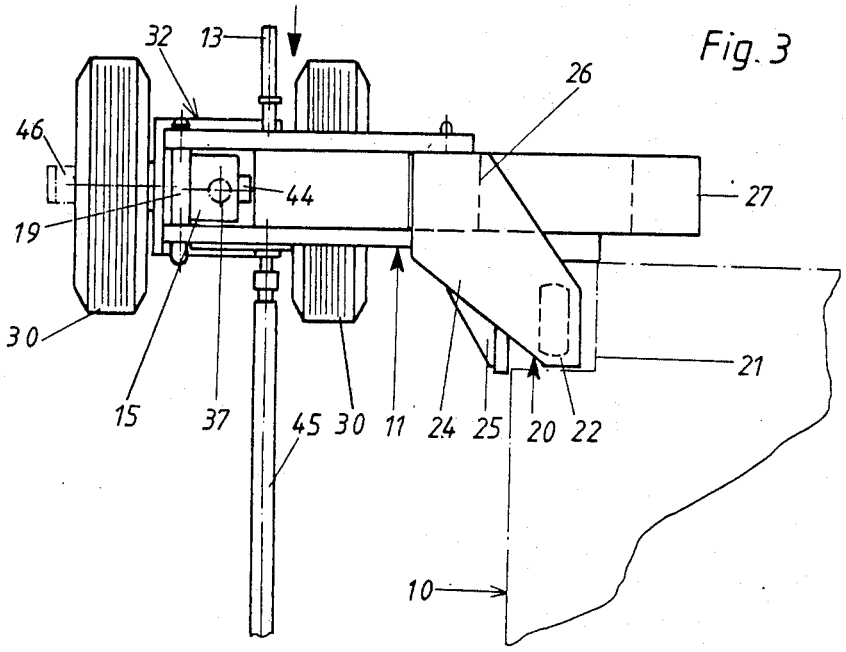
Fig. 3
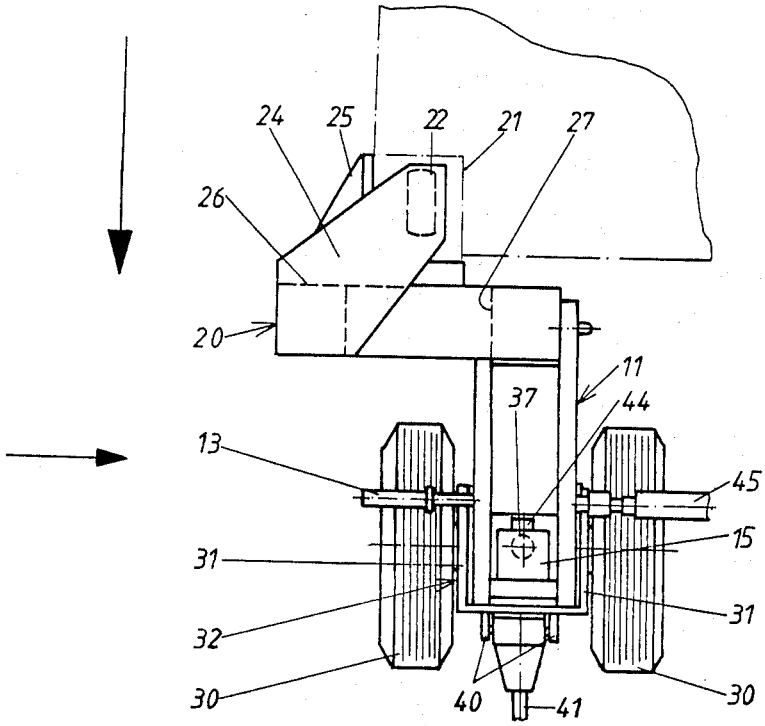

24
21
10
26
$B_2$
13
12
27
19A
19B
$B_2$
21
490
23
25
44
15
30
35
36
32

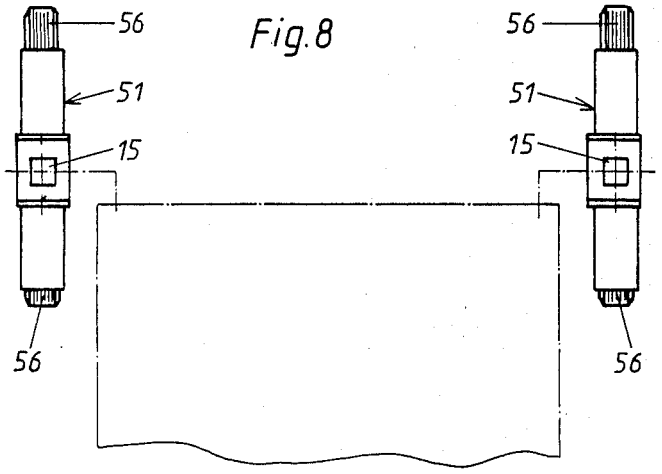
Fig. 8
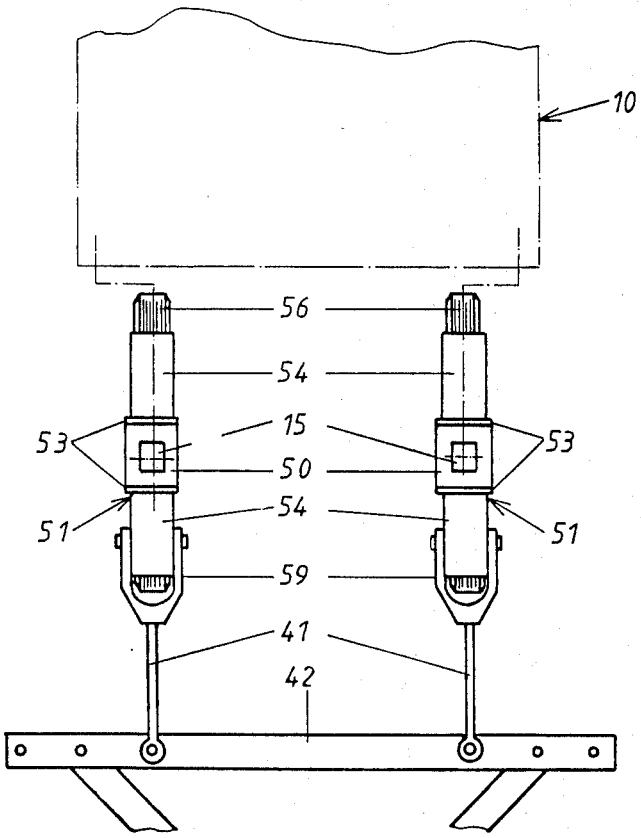

LIFTING AND DEPOSITING DEVICE FOR TRANSPORTABLE LARGER CONTAINERS, E.G. COMPARTMENTS OR THE LIKE

BACKGROUND OF THE INVENTION

The present invention relates to a device for lifting and depositing transportable large containers, e.g., compartments or the like, with rack and pinion jacks to be fastened to the container corners by means of overhang beams of which racks are provided on uprights for those large containers and which can be raised and lowered along each upright, and the uprights can be provided with wheels for movement of the lifting and depositing device and the large containers with it.

A lifting and depositing device of this type has been disclosed in German DE-PS No. 32 26 882. In order to lift a container from the ground or to place it on the ground, an open space is provided beneath the rack and pinion jack of this device to receive the wheels at the bottom ends of the uprights. The uprights with the attached wheels, with the hoist gearing moved aside, can then be introduced into the opened winch housing from the outside from the side, which however is complicated because of the great weight of the uprights with wheels to be dealt with. Furthermore, during lifting of a container into a higher position, in order also to sufficiently guide the uprights beneath the rack and pinion jack, this known device requires the provision of hinged auxiliary support guides, which can be coupled with the pivotable gearings of the rack and pinion jack. This device is structurally costly and its operation requires great supervision.

SUMMARY OF THE INVENTION

The object of the present invention is to provide a lifting and depositing device for large containers which is structurally simple and easy to operate, in which the rack and pinion jacks to be attached to the corners of the containers by means of overhang beams can be arranged with their guide members for the uprights lying far down relative to the container (i.e. near the bottom) and also the uprights and the wheels associated with them can be attached, when the container to be handled is resting on the ground. Thus, a separate attachment of the uprights and wheels is made possible to facilitate of the assembly of the device.

According to the present invention, this is accomplished by mounting the wheels on a wheel support, which has a base plate surface for the bottom end of the upright, which is arranged lower than the wheel axle, so that when the large container is deposited on the ground, the wheel support with the base plate surface can be driven from the side under the rack and pinion jack, in order to place the bottom end of that upright to the base plate surface and to couple them together, and for control of the device, the wheel support can be rotated relative to the uprights or to the wheels on the wheel support. Such a movable lifting and depositing device is structurally quite simple and of correspondingly low cost in its manufacture. Also, its assembly is quite simple, because one need only fasten the rack and pinion jack with its overhand beams to roll to the container corners in order to lift a container which is on the ground, and then to roll the wheels with their wheel support beneath the rack and pinion jacks or the winch housing, and introduce the supports into the winch housing and to superpose their bottom ends on the base plate support surface of the wheel support and to couple these together.

Since a separate attachment of the supports and wheels is possible, the assembly is greatly simplified in comparison with the present state of the art. Furthermore, since the base plate support surfaces on the wheel supports can be positioned very low, i.e. only a slight distance above the ground, the winch housing with its support guides can also be positioned correspondingly far down on the container corners. For the drive and control of the device, one need only lift the container slightly by operation of the rack and pinion jack, so that there is some play present between the wheels and the bottom of the rack and pinion jack or the winch housing with the support guides, i.e., there are only very short lengths of the supports to the sides beneath the winch housing which are unsupported, so that there is no longer any instability of the device.

If, for instance, twin wheels are desired or required, according to a further development of the invention, the wheel support has a U-shaped section, and has one wheel on each arm support on the same axis, and it is provided with a base plate support surface for an upright on its horizontal crossbar. For the attachment of such a pair of wheels, the wheel support is rolled under the winch housing or the upright guide so that both of its arms engage under these parts with some play at the sides.

In another configuration of the invention, if the wheel support has an impact plate attached to the front, its attachment to a winch housing or an upright base or to an upright itself is simplified. During the rolling movement or the wheel support, if the impact plate contacts the winch housing or the upright guide or support, the guide or support is aligned on the base place support surface of the wheel support, so that when the upright then is introduced, it can be brought into position and coupled with this member.

It could be advantageous to have connection elements for traction and/or steering members attached to the outside of the impact plate, these members being required for movement of the lifted up container into a travel position.

In still another configuration of the invention, the wheel support has a U-shaped lengthwise section, and its arms carry top horizontal arms extending outward in both directions to which are suspended the wheels which can rotate around a vertical axis, while the base plate support surface is provided for an upright on the horizontal crossbar of the wheel support. In this version, the wheels run one after the other on each support during "forward movement" of a large container.

Another configuration of the invention is characterized in that the base plate support surface on each wheel support can be connected rotatably with the bottom end of the upright by a guide. This guide allows a simple rotary coupling of the uprights with their wheel supports.

The guide can be attached to the base plate surface of the wheel support and can be brought into engagement with an axial borehole in the bottom end of the upright, or the guide can be attached to the bottom end of the upright and be brought into engagement with a borehole in the base plate surface on the wheel support.

It is preferable that the guide be held in its relevant receiver borehole and, e.g., the wheels which are following behind during movement of a large container can be held parallel to the direction of travel.

According to still another development of the invention, if the guide is arranged axially adjustable on the base plate surface of the wheel supports and can be stopped in both of its end positions, then the assembly of the uprights with the wheel supports is further simplified.

Furthermore, according to still another development of the invention, if the base plate support surface for an upright is provided on a rocker which is mounted pivotally around a horizontal axis on the wheel support, then any unevenness of the ground is compensated for during movement.

It is especially advantageous to use the features of the invention with a rack and pinion jack, of which the winch housing can be opened in a known manner for introduction for an upright. The mounting and coupling of the bottom end of an upright on or with the base plate surface on the wheel support is thus further simplified. A winch housing to be opened for side introduction of an upright is known, e.g., from German DE-GM No. 35 609.

BRIEF DESCRIPTION OF THE DRAWINGS

The invention will be explained relative to the drawings of exemplary embodiments, which show:

FIG. 3 is a plan view of one half of the arrangement shown in FIG. 2, but with the individual elements of the attachment of a pair of wheels and the overhang beam for the rack and pinion jack on the corners of the container;

FIG . 7 is a side elevational view of a container corner with attached rack and pinion jack and a second embodiment of a wheel support for a pair of wheels; and FIG. 8 is a plan view of two large containers shown partially in broken lines, which are mounted on wheel supports as shown in FIG. 7.

DESCRIPTION OF THE PREFERRED EMBODIMENTS

Figure 1:
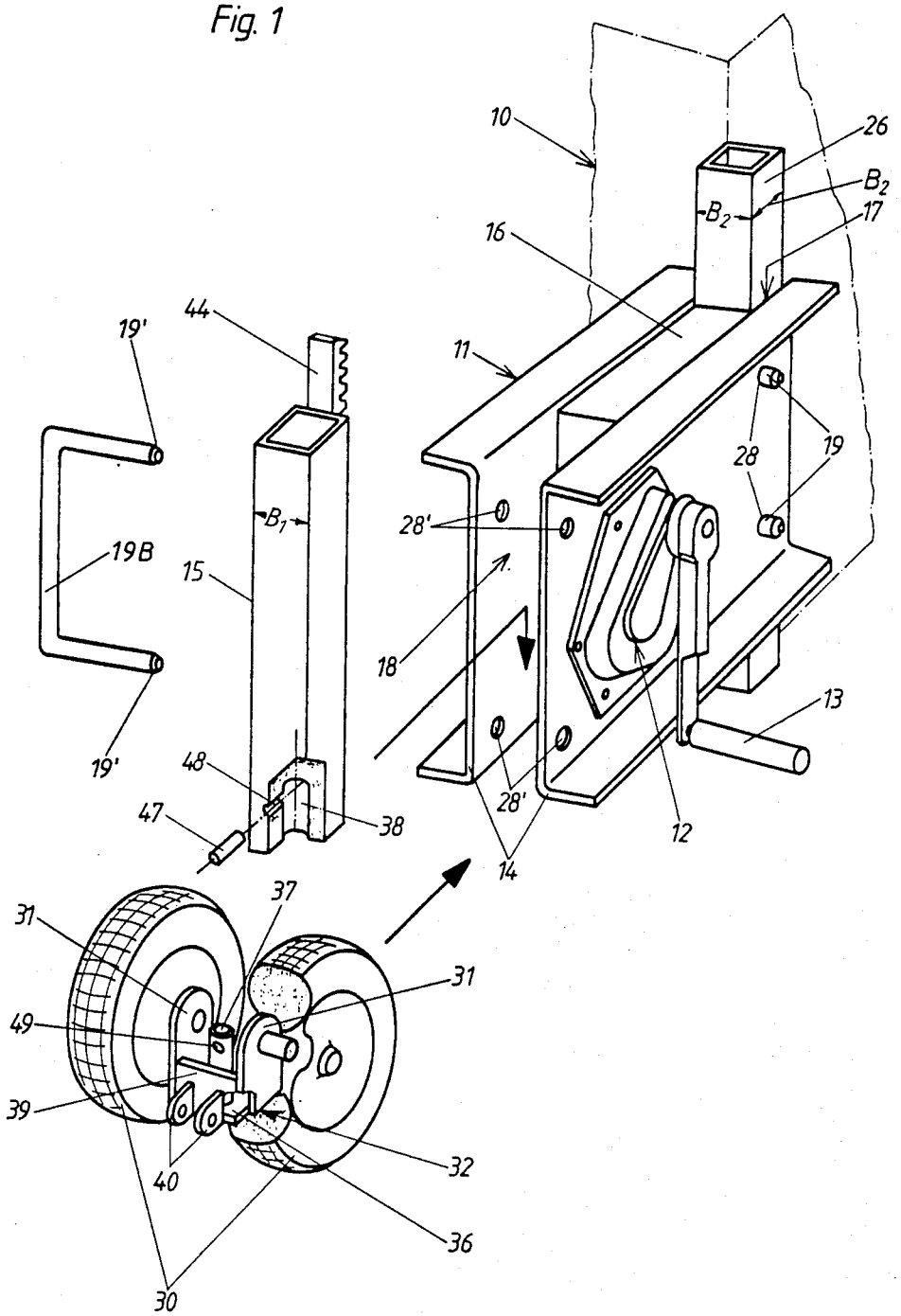
FIG. 1 is an exploded perspective view of a rack and pinion jack attached to a container corner by means of an overhang beam, with a part of an upright with rack and a pair of wheels, which is mounted on a wheel support according to the invention, partially in cross section and with parts broken away.

The movable lifting and depositing device as in FIGS. 1–6 or 7 and 8 is for a large container 10 (e.g. a container, compartment or the like) of a rectangular shape which, e.g., is to be lifted from the ground to a cargo plane, a truck or the like, and over an oblique ramp into its cargo space and then deposited. If only a loading ramp, a plank bed or the like (with rollers) is present instead of an oblique entrance ramp, at the level of the loading base and/or the transfer plane, then large container 10 must be lifted by the lifting and depositing device insofar as it can also be deposited on this horizontal loading ramp. The work steps can also be carried out in reverse order, if a large container is to be removed from a cargo plane or from a truck. Furthermore, the lifting and depositing device must be constructed so that the large container can also be moved into the cargo space of the aircraft or other transport means, if no rollers are present on the floor of the cargo space.

The lifting and depositing device for this purpose has four detachably fastened overhang beams 11 of identical structure far down at the corners of large container 10, each of which supports a rack and pinion jack 12, which can be operated by a hand crank 13. Each overhang beam 11 consists of a structure disclosed in German Utility Pat. No. 82 35 609.2, which has two plates 14 with U-shaped profile which is open at the top. Plates 14 are connected in the space of the width B 1 (FIG. 1) of an upright 15, which consists of a rectangular hollow pipe, with the aid of one or more spacers 16. Several spacers 16 are connected to each overhang beam 11. Each overhang beam 11 is associated with an upright 15 in a manner which will be explained hereinafter. Plates 14 are welded to spacers 16 by their flat-surfaced sides, in such a manner that one end of overhang beam 11 includes the attachment area 17 and the opposite end winch 12 has a vertical guide space 18 for upright 15.

The detachable connection of overhang beam 11 with the corners of large container 10 can for instance be effected by means of a U-shaped bracket 19 A (FIG. 5), of which only the ends of its two horizontal arms 19 can be seen in FIG. 1. Metal corner fittings are found at each corner of container 10 at the top and bottom (FIGS. 3–6), to each of which is attached a connecting part 20 (FIGS. 3–6), in the customary manner by means of lugs 22 and screws 23. This connector 20 has overhang beams 24, 25, at the top and bottom, which support a rectangular pipe member 26 arranged perpendicular to and approximately the height of the container. At the bottom, another rectangular pipe 27 is attached at the side at some distance and perpendicular thereto. In FIG. 1, only the top view of rectangular pipe 26 is shown.

The edge dimensions B 2 (FIG. 1) of rectangular pipes 26 and 27 correspond to the width B 1 of upright 15. The extent of attachment space 16 is identical to the edge dimensions B 2, so that the attachment of overhang beam 11 to a corner of a container causes rectangular pipe 26 (or 27) to be introduced into chamber 16 and fills its U-shaped section. On rectangular pipes 26 and 27 on the four corners of large container 10 are found horizontal boreholes for the passage of both arms 19 of U-shaped bracket 19 A that are worked in at corresponding vertical spacing. Plates 14 likewise have boreholes 28 aligned with corresponding vertical spacing to the side for the passage of side pieces 19 or the U-shaped fitting 19 A. Following fitting of an overhang beam 11 on one of the rectangular pipes 26 or 27, and alignment of the aforementioned boreholes in the relevant rectangular pipe and in plates 14, the U-shaped bracket 19 A passes from the side with its arms 19 through these boreholes, whereupon overhang beam 11 is fastened detachably to that container corner.

Figure 4B:
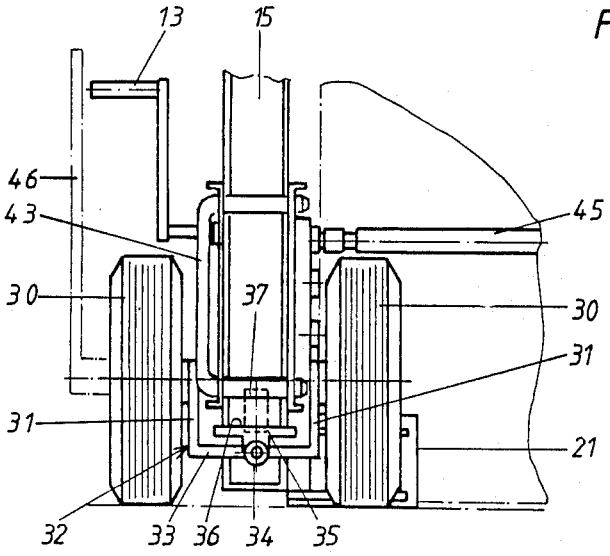
FIG. 4*b* is a front elevational view of the wheel arrangement of FIG 4*a*, with a large container resting on the ground.
Figure 4A:
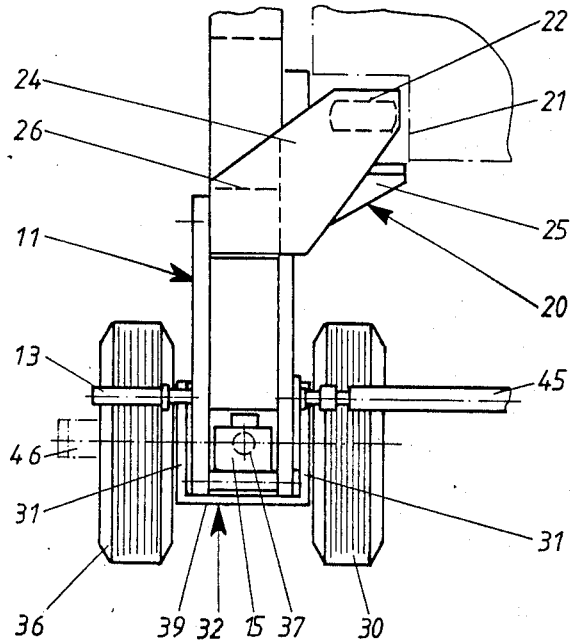
FIG. 4*a* is another plan view of a corner of the container with a different version of the wheel arrangement.
Figure 5:
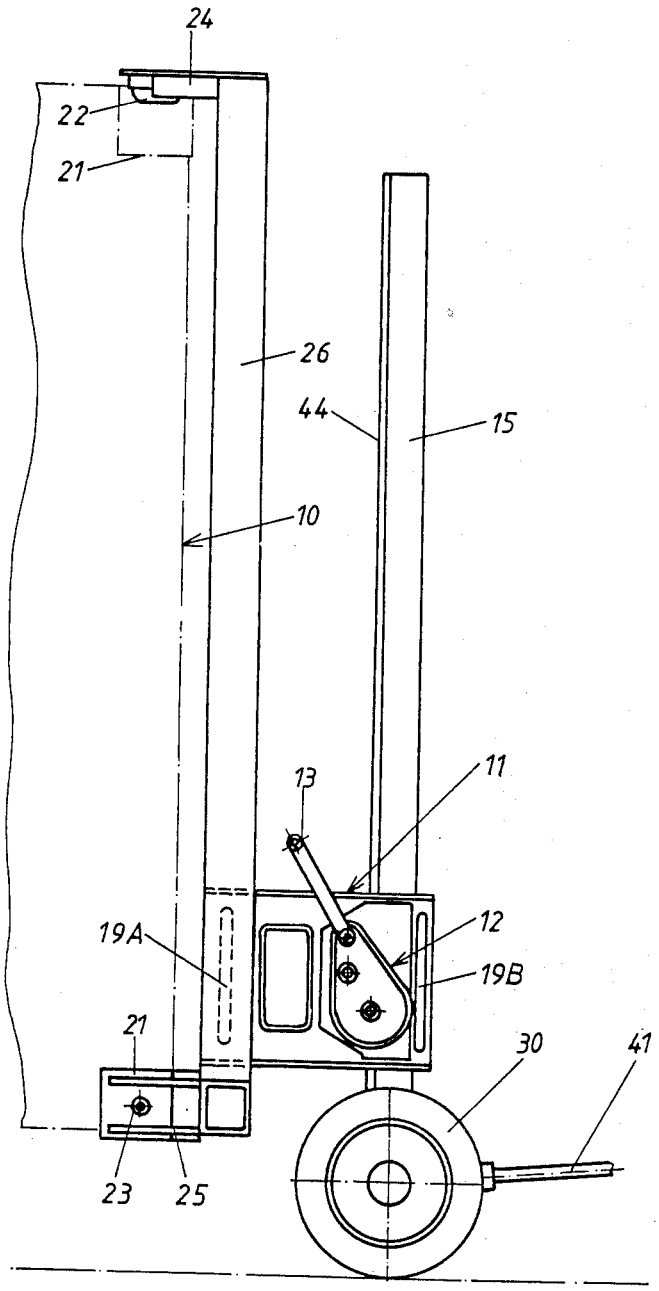
FIG. 5 is a side elevational view of a wheel arrangement on a container corner in the direction of arrow A of FIG. 3, with the rack and pinion jack and therewith the large container being raised into travel position (1st stage)

Assuming that the large container 10 is placed on the ground (as shown in FIG. 4) and is then to be placed in a cargo plane some distance away, overhang beams 11 are mounted at the four container corners, beneath guide spaces 18 for uprights 15 of wheels 30.

In the exemplary embodiment of FIGS. 1–6, each two wheels 30 of the same axle are mounted on the arms 31 of a wheel support 32 of U-shaped section. A rocker 35 is arranged on the crossbar 33 (FIG. 4*b*) of each wheel support 32, where it is pivotable around a horizontal axis 34 running parallel to arm 31, which bears a base plate surface 36 for the bottom end of an upright 15. A guide 37 is attached on base plate support surface 36, which is intended to engage in an axial borehole 38 (FIG. 1) in the bottom of each upright 15.

Figure 2:
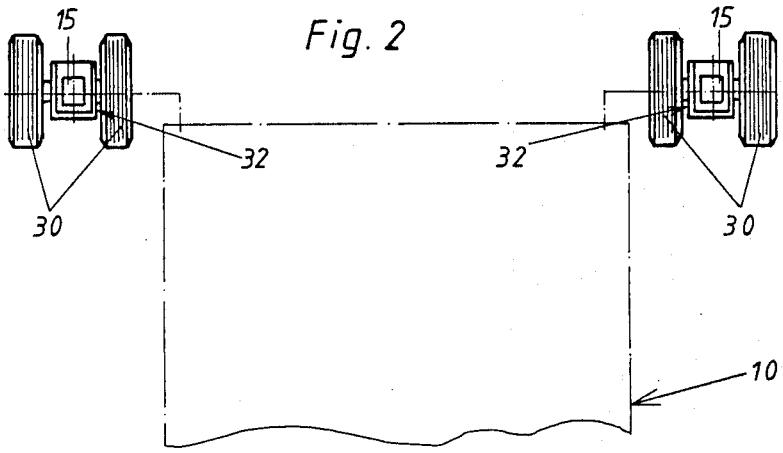
FIG. 2 is a plan view of two large containers shown partially in broken lines, at the corners of which are found a pair of wheels which correspond to those of FIG. 1.
Figure 2:
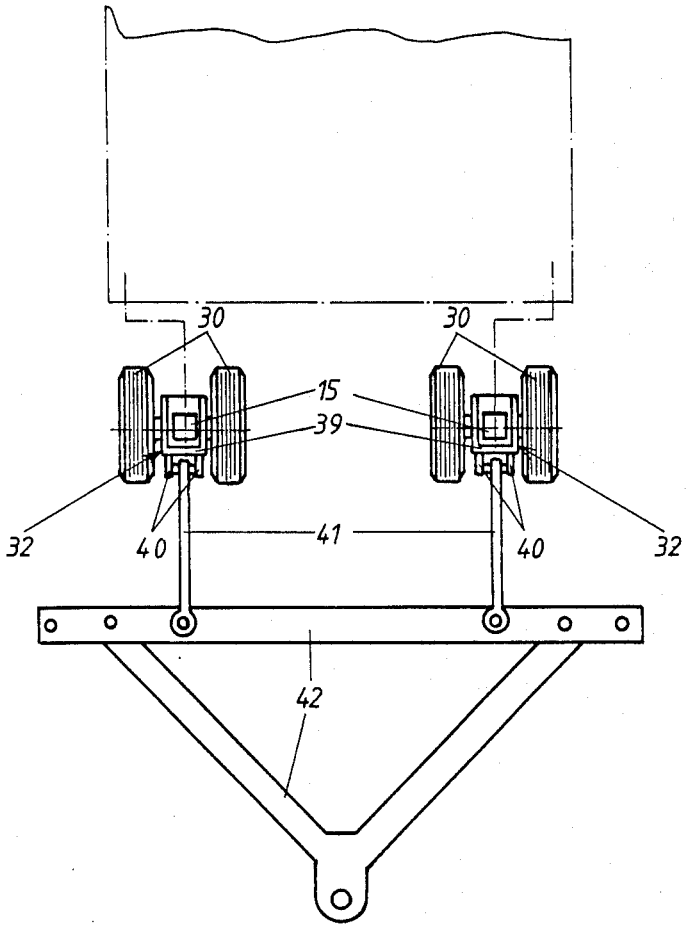

Between arms 31 of wheel support 32 is attached an impact plate 39, on the front of wheel support 32. Connectors 40 are found on the outside of impact plate 39 for traction and control bars 41 (FIG. 2). Two traction and control bars 41 of this type, which are associated with two pairs of wheels, can be connected with a pole 42, which can be coupled with a traction engine.

The distance to the side of arm 31 from wheel support 32 is such and the base plate support surface 36 lies so low on rocker 35 that a wheel support 32 with support surface 36 can be positioned under an overhang beam 11 or rolled (in the direction of the arrow in FIG. 1), until impact plate 39 engages the front edges of plates 14 of overhang beam 11. When the wheel support is in this position, upright 16, introduced from the front into open guide space 18, can be aligned with its bottom end on base plate 36 of rocker 35, and guide 37 in borehole 38 engages the bottom end of upright 15. Then, for holding upright 15 in guide space 18, a bracket 19 B corresponding to the aforementioned U-shaped bracket 19 A with its arms 19' can be fitted from the side through aligned boreholes 28' into plates 14, projecting into assembled position by a split pin (not shown) or the like. A winch 44 is attached to each upright 15, where it remains in engagement with a driving pinion (not shown) of rack and pinion jack 12, if upright 15 is introduced into guide space 18.

When uprights 15 and wheels 30 are attached to all four overhang beams 11 in the described manner, the rack and pinion jacks 12 are operated by rotation of hand cranks 13, in order to lift the four overhang beams 11 and thereby lift large containers 10 on uprights 15 into travel position (lst stage), which is shown in FIG. 4, and wherein a certain amount of play is present between wheels 30 and the bottoms of overhang beams 11 or winches 12, which allows rotation of wheels 30 around an axis of uprights 15 or boreholes 38 in the bottom ends of uprights 15. In order to be able to operate only two rack and pinion jacks 12 for lifting large container 10, each two rack and pinion jacks 12 which are side by side are drive-connected with each other by shafts 45.

The front pairs of wheels in FIGS. 2 and 3 and the rear pairs (not shown) of wheels are already aligned in the travel direction following the assembly of their wheel support 32. The rear two pairs of wheels in FIGS. 2 and 3 and in a corresponding manner the front pair (not shown) of wheels on the contrary must not be brought into a lift state until following assembly and attachment to their wheel support 32, and then are lifted into the travel direction shown in FIGS. 2 and 3. For this purpose, a lever 46 is attached to the hub of one of the wheels 30, whereby the wheel can be rotated in the travel direction. Wheel supports 32 of the two rear pairs of wheels are then prevented from rotating. This is accomplished by a safety bolt 47 (FIG. 1) inserted through borehole 48 in the bottom end of upright 15 and into a borehole 49 of the relevant guide 37. The rotary movement of both front pairs of wheels each around a vertical axis on the contrary must be held for the steering processes.

Figure 6:
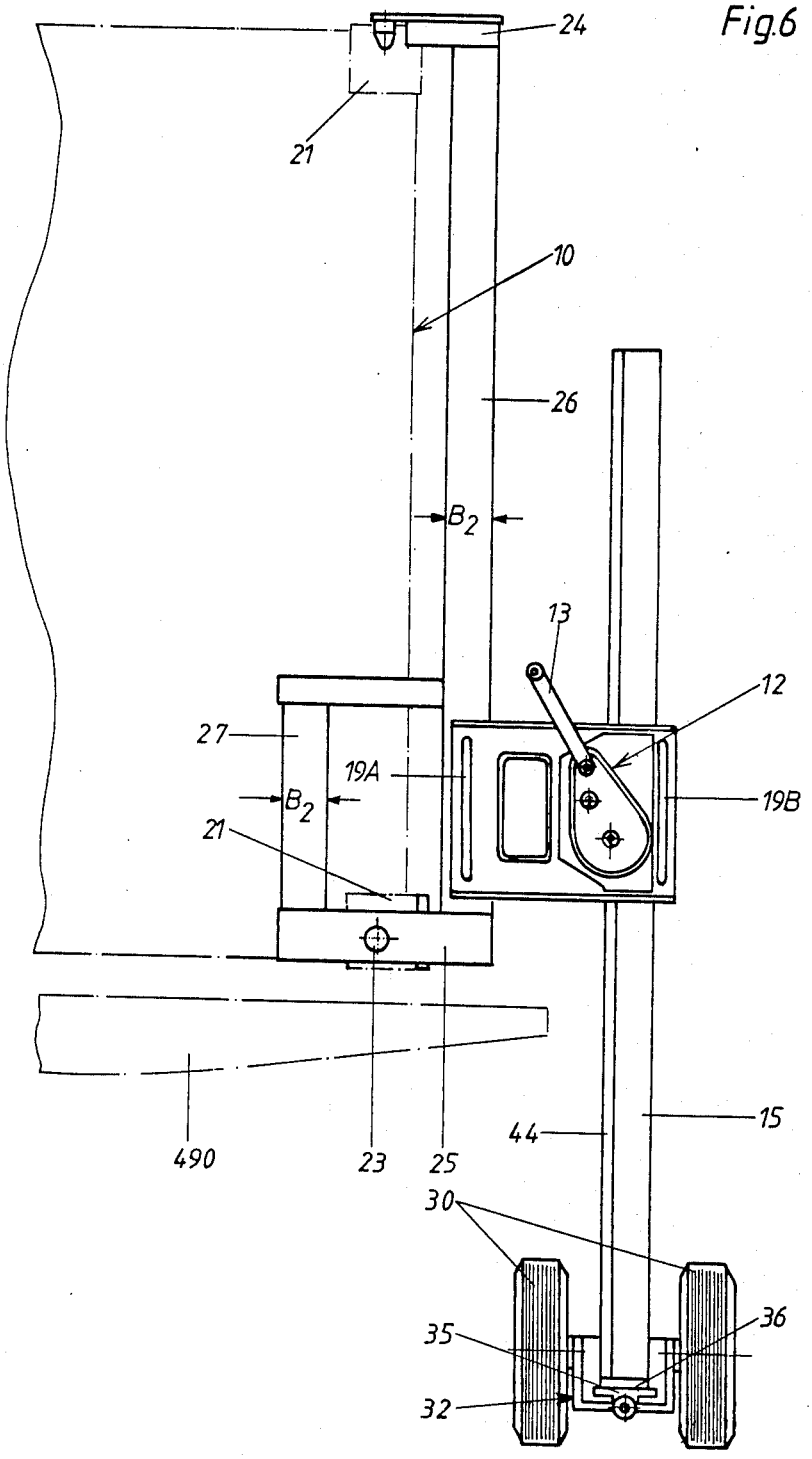
FIG. 6 is an elevational view of a container corner with attached rack and pinion jack and a pair of wheels in the direction of arrow B of FIG. 3, wherein the large container is raised to a second stage for placement on a loading ramp.

According to requirements, the front and rear pairs of wheels are arranged at the same distances, so that a wide or a narrow gauge is obtained. This is selected depending upon whether larger container 10, for instance, can be driven over an oblique ramp (without further lifting into the 2d stage) feeding directly into the cargo space, e.g., of a cargo plane or some other transport vehicle. The wide gauge on the contrary is used if large container 10 is to be deposited on a raised up horizontal loading ramp 490 of the cargo plane or some other transport vehicle, as shown in FIG. 6. Here it is also required that rack and pinion jack 12 be used once again, in order to lift large container 10 to a second stage, which allows transfer to horizontal loading ramp 490. Following placement of large container 10 on loading ramp 490, the lifting and depositing device is fastened on and the container is rolled into the cargo space. Loading ramp and cargo space in this case have rollers on the bottom.

Figure 7:
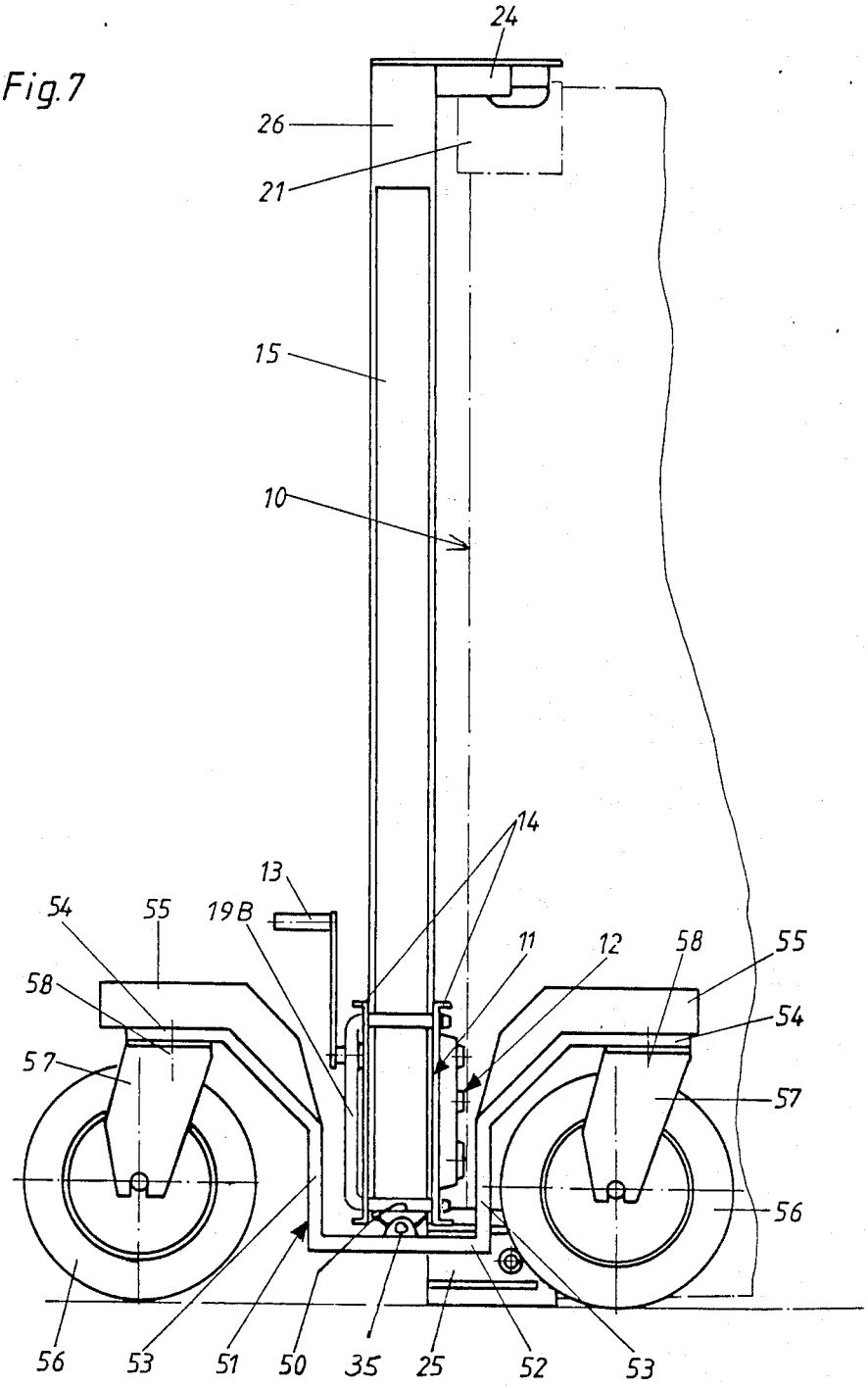

FIGS. 7 and 8 show a second exemplary embodiment, wherein the same parts are indicated with the same reference numerals as in FIGS. 1–6. Wheel support 51 here has a U-shaped lengthwise section. Rocker 35 is supported on the horizontal crossbar 52 of wheel support 51, and upright 15 is mounted on surface 50. Two arms 53 extend perpendicularly upward from crossbar 52, at the top of which are found horizontal arms 54 extending in opposite directions. These arms 54 carry reinforcement plates 55 at the top. One wheel 56 is suspended on each arm by means of a forked support 57. Forked wheel supports 57 are mounted rotatable around vertical axes 58 on arms 54, and these rotary axes 58 are aligned in lengthwise direction on wheel support 51 relative to each other.

The arrangement of this wheel support 51 on the container corners, as shown in FIG. 8, can be as in the first exemplary embodiment. Therefore the arrangement of the four pairs of wheels in "narrow gauge" or "wide gauge" is possible, dependent upon the relevant requirements. The traction and steering bars 41 are connected at the rear with forked connectors 59, which in turn can be pivoted around a horizontal axis with one arm 54 each, and coupled with wheel support 51. Also in this emplary embodiment, base plate support surfaces 50 for the bottom ends of uprights 15 are so low that wheel supports 51 can be driven under overhang beams 11 or rack and pinion jacks 12, if large container 10 is on the ground, as is shown in FIG. 7.

We claim:

1. Lifting and depositing device for transportable large containers, comprising rack and pinion jacks to be attached to the container corners by means of overhang beams, the jacks having winches provided on uprights so that they can be raised and lowered along each upright, the uprights having wheels for moving the lifting and depositing device and therewith moving a large container, the wheels being mounted on a wheel swiveling mechanism, which has a support surface for the bottom end of the uprights, and the wheel swiveling mechanism being rotatable relative to the uprights for controllability of the device, characterized in that the support surface (36) for an upright (15) is provided on a rocker (35) mounted on the wheel swiveling mechanism (32) for rotation about a substantially horizontal axis (34), the support surface (36) is rotatably connected to the bottom end of the upright (15) by a guide means, and that the support surface (36) is arranged lower in relation to an axis of the wheels, that the wheel swiveling mechanism (32, 51) can be moved when the large containers (10) are placed on the ground to the side beneath the rack and pinion jack (12), to position the bottom end of the relevant upright (15) on the support surface (36, 50) to support and couple them.

2. Device as in claim 1, characterized in that the guide means is a guide pin (37).

3. Device as in claim 2, characterized in that the guide pin (37) is fastened to the support surface (36) of the rocker (35) and can be brought into fitted engagement with an axial bore (38) in the bottom end of the upright (15).

4. Device as in claim 2, characterized in that the guide pin is fastened at the bottom end of the upright and can be brought into fitted engagement with a bore in the support surface.

5. Device as in claim 4, characterized in that the guide pin (37) can be stopped (47) in its relevant receiving bore (38).

6. Device as in claim 4, characterized in that the guide pin is arranged axially adjustable at the bottom end of the upright or on the support surface, and can be stopped in both of its end positions.

7. Devices as in claim 4, characterized in that the wheel swiveling mechanism (51) has a U-shaped lengthwise cross section and its side pieces (53) support top, horizontal arms (54) extending outwardly in opposite directons, to which the wheels (56) are suspended, each of said wheels (56) being rotatable around a vertical axis (58), and that the support surface (50) for an upright (15) is provided on the horizontal crosspiece segment (52) of the wheel swiveling mechanism (51).

8. Device as in claim 1, characterized by its use with a rack and pinion jack (12) having a winch housing which can be opened for the introduction of an upright (15) from the side.

* * * * *